US011215349B1

(12) United States Patent
Wu

(10) Patent No.: US 11,215,349 B1
(45) Date of Patent: Jan. 4, 2022

(54) LAMP BEAD AND LAMP STRIP

(71) Applicant: Shenzhen Tairan Lighting Co., Ltd., Guangdong (CN)

(72) Inventor: Yingxiang Wu, Yingtan (CN)

(73) Assignee: SHENZHEN TAIRAN LIGHTING CO., LTD., Guangdong (CN)

( * ) Notice: Subject to any disclaimer, the term of this patent is extended or adjusted under 35 U.S.C. 154(b) by 0 days.

(21) Appl. No.: 17/115,978

(22) Filed: Dec. 9, 2020

(30) Foreign Application Priority Data

Sep. 22, 2020 (CN) ..... 202010999706.9

(51) Int. Cl.

| | |
|---|---|
| ***F21V 23/06*** | (2006.01) |
| ***F21V 23/00*** | (2015.01) |
| *F21Y 103/10* | (2016.01) |
| *F21Y 115/10* | (2016.01) |

(52) U.S. Cl.
CPC ..... *F21V 23/06* (2013.01); *F21V 23/009* (2013.01); *F21Y 2103/10* (2016.08); *F21Y 2115/10* (2016.08)

(58) Field of Classification Search
CPC ..... H01L 25/0753; H01L 33/62
See application file for complete search history.

(56) References Cited

U.S. PATENT DOCUMENTS

| | | | | |
|---|---|---|---|---|
| 8,641,220 | B1 * | 2/2014 | Lin | F21V 23/0492 362/103 |
| 2004/0051474 | A1 * | 3/2004 | Wong | A41D 27/085 315/291 |
| 2005/0213321 | A1 * | 9/2005 | Lin | F21S 4/26 362/231 |
| 2018/0182945 | A1 * | 6/2018 | Shimabukuro | H01L 33/62 |

* cited by examiner

*Primary Examiner* — Keith G. Delahoussaye
(74) *Attorney, Agent, or Firm* — Allen Dyer Doppelt et al.

(57) ABSTRACT

The disclosure provides a lamp bead and a lamp strip. The lamp bead includes a packaging housing, one or more LED lamps and an LED lamp driving chip; the LED lamps and the LED lamp driving chip are arranged in the packaging housing; and a power positive pole connection terminal, a signal connection terminal and a power negative pole connection terminal which are arranged longitudinally are exposed on an outer side of the bottom of the packaging housing. In the disclosure, through the packaging structure of the power positive pole connection terminal, the signal connection terminal and the power negative pole connection terminal which are arranged longitudinally, during wiring, power positive pole connection terminals of all beads are in a straight line, power negative pole connection terminals thereof are in a straight line, and signal connection terminals thereof are in a straight line.

19 Claims, 6 Drawing Sheets

LAMP BEAD AND LAMP STRIP

TECHNICAL FIELD

The disclosure relates to the technical field of LED lamp design, and in particular, to a lamp bead and a lamp strip.

BACKGROUND

An existing light strip is formed by mounting LEDs on a flexible or hard circuit board. Copper foil of the printed circuit board is connected to LED lamps for power supply and data transmission. FIG. 1 shows the structure of an existing LED lamp and FIG. 2 shows the structure of an existing lamp strip. From FIGS. 1 and 2, it can be seen that LED lamps with the same size need a wider circuit board, and the wiring is more chaotic. Due to the packaging structure of the LED lamp, there is often a waste on circuit board materials and the wiring is complicated. It is more difficult to connect by using conventional wires or enameled wires. Since the wires are not parallel, it is difficult to arrange the wires uniformly, and the wires need to be welded segment by segment. The process is complex, and there are many welding points. This leads to problems in later use and poor reliability.

SUMMARY

The disclosure provides a lamp bead and a lamp strip to overcome the technical shortcoming of complex wiring caused by the packaging structure of the existing LED lamp.

To achieve the above purpose, the disclosure provides the following technical solutions.

A lamp bead is provided, including a packaging housing, one or more LED lamps and an LED lamp driving chip; where the LED lamps and the LED lamp driving chip are arranged in the packaging housing;

a power positive pole connection terminal, a signal connection terminal and a power negative pole connection terminal which are arranged longitudinally are exposed on an outer side of the bottom of the packaging housing; the signal connection terminal includes a first signal connection terminal and a second signal connection terminal which are transversely arranged; the power positive pole connection terminal, the signal connection terminal and the power negative pole connection terminal pass through the bottom of the packaging housing;

a first signal end and a second signal end of the LED lamp driving chip are connected to the first signal connection terminal and the second signal connection terminal, respectively:

a power positive pole input end and a power negative pole input end of the LED lamp driving chip are connected to the power positive pole connection terminal and the power negative pole connection terminal, respectively;

anodes of the one or more LED lamps are connected to the power positive pole connection terminal; and cathodes of the one or more LED lamps are connected to one or more LED input ends of the LED lamp driving chip in a one-to-one correspondence manner, respectively.

Optionally, the power positive pole connection terminal, the signal connection terminal and the power negative pole connection terminal are sequentially arranged from top to bottom; or the power negative pole connection terminal, the signal connection terminal and the power positive pole connection terminal are sequentially arranged from top to bottom; or the signal connection terminal, the power positive pole connection terminal and the power negative pole connection terminal are sequentially arranged from top to bottom; or the signal connection terminal, the power negative pole connection terminal and the power positive pole connection terminal are sequentially arranged from top to bottom.

Optionally, the power positive pole connection terminal, the signal connection terminal and the power negative pole connection terminal are in forms of welded pieces, pins and/or terminal blocks.

Optionally, the lamp bead further includes a printed circuit board (PCB), where the LED lamps, the LED lamp driving chip, the power positive pole connection terminal, the signal connection terminal and the power negative pole connection terminal are arranged on the PCB.

Optionally, the LED lamp driving chip is VIPER22A™, where the VIPER22A™ is a driving chip with an eight terminal pinout.

A lamp strip includes a plurality of the above lamp beads, where first signal connection terminals and second signal connection terminals of the plurality of lamp beads are sequentially connected in series, power positive pole connection terminals of the plurality of lamp beads are connected with each other, and power negative pole connection terminals of the plurality of lamp beads are connected with each other.

Optionally, the lamp strip further includes a power supply and a controller, where the power supply is connected to a power input end of the controller;

a power positive pole output end of the controller is connected to the power positive pole connection terminals of the plurality of lamp beads, and a power negative pole output end of the controller is connected to the power negative pole connection terminals of the plurality of lamp beads; and a signal output end of the controller is connected to a first signal connection terminal of the first lamp bead of the plurality of lamp beads which are sequentially connected in series.

Optionally, the power supply, the controller and the plurality of lamp beads are connected through a circuit board, a wire or an enameled wire.

According to specific examples of the disclosure, the disclosure has the following technical effects.

The disclosure provides a lamp bead. The lamp bead includes a packaging housing, one or more LED lamps and an LED lamp driving chip. The LED lamps and the LED lamp driving chip are arranged in the packaging housing. A power positive pole connection terminal, a signal connection terminal and a power negative pole connection terminal which are arranged longitudinally are exposed on an outer side of the bottom of the packaging housing. A first signal end and a second signal end of the LED lamp driving chip are connected to the first signal connection terminal and the second signal connection terminal, respectively. A power positive pole input end and a power negative pole input end of the LED lamp driving chip are connected to the power positive pole connection terminal and the power negative pole connection terminal, respectively. Anodes of the one or more LED lamps are connected to the power positive pole connection terminal; and cathodes of the one or more LED lamps are connected to one or more LED input ends of the LED lamp driving chip in a one-to-one correspondence manner, respectively. In the disclosure, through the packaging structure of the power positive pole connection terminal, the signal connection terminal and the power negative pole connection terminal which are arranged longitudinally, during wiring, power positive pole connection terminals of all beads are in a straight line, power negative pole connection terminals thereof are in a straight line, and signal connection terminals thereof are in a straight line. This simplifies the wiring and overcomes the technical shortcoming of complex wiring caused by the packaging structure of the existing LED lamp.

BRIEF DESCRIPTION OF THE DRAWINGS

To describe the technical solutions in the examples of the disclosure or in the prior art more clearly, the following briefly describes the accompanying drawings required for the examples.

Apparently, the accompanying drawings in the following description show merely some examples of the disclosure, and a person of ordinary skill in the art may still derive other accompanying drawings from these accompanying drawings without creative efforts.

DETAILED DESCRIPTION

Figure 1:
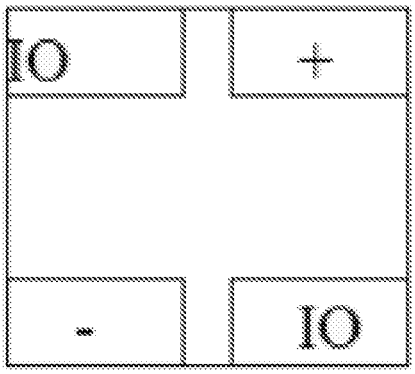
FIG. 1 (Prior Art)
FIG. 1 is a schematic diagram of a packaging structure of an LED lamp in the prior art provided according to the disclosure.
Figure 2:
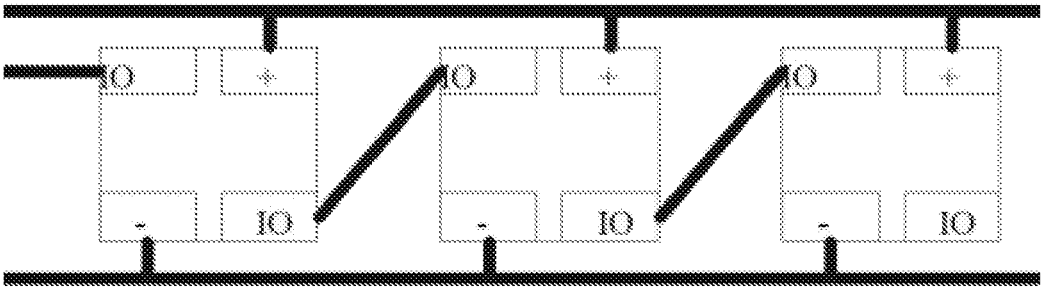
FIG. 2 (Prior Art)
FIG. 2 is a schematic diagram of a wiring structure of a lamp strip composed of a plurality of LED lamps in the prior art provided according to the disclosure.

The following clearly and completely describes the technical solutions in the examples of the disclosure with reference to accompanying drawings in the examples of the disclosure. Apparently, the described examples are merely some rather than all of the examples of the disclosure. All other examples obtained by a person of ordinary skill in the art based on the examples of the disclosure without creative efforts shall fall within the protection scope of the disclosure.

The disclosure provides a lamp bead and a lamp strip to overcome the technical shortcoming of complex wiring caused by the packaging structure of the existing LED lamp.

In order to make the foregoing objectives, features, and advantages of the disclosure more understandable, the disclosure will be further described in detail below with reference to the accompanying drawings and specific implementations.

The disclosure provides a lamp bead. The lamp bead includes a packaging housing, one or more LED lamps and an LED lamp driving chip. The LED lamps and the LED lamp driving chip are arranged in the packaging housing. A power positive pole connection terminal, a signal connection terminal and a power negative pole connection terminal which are arranged longitudinally are exposed on an outer side of the bottom of the packaging housing. The signal connection terminal includes a first signal connection terminal and a second signal connection terminal which are transversely arranged. The power positive pole connection terminal, the signal connection terminal and the power negative pole connection terminal pass through the bottom of the packaging housing. A first signal end and a second signal end of the LED lamp driving chip are connected to the first signal connection terminal and the second signal connection terminal, respectively. A power positive pole input end and a power negative pole input end of the LED lamp driving chip are connected to the power positive pole connection terminal and the power negative pole connection terminal, respectively. Anodes of the one or more LED lamps are connected to the power positive pole connection terminal; and cathodes of the one or more LED lamps are connected to one or more LED input ends of the LED lamp driving chip in a one-to-one correspondence manner, respectively. The power positive pole connection terminal, the signal connection terminal and the power negative pole connection terminal are sequentially arranged from top to bottom; or the power negative pole connection terminal, the signal connection terminal and the power positive pole connection terminal are sequentially arranged from top to bottom; or the signal connection terminal, the power positive pole connection terminal and the power negative pole connection terminal are sequentially arranged from top to bottom; or the signal connection terminal, the power negative pole connection terminal and the power positive pole connection terminal are sequentially arranged from top to bottom. The power positive pole connection terminal, the signal connection terminal and the power negative pole connection terminal are in forms of pins and/or terminal blocks. The lamp bead further includes a printed circuit board (PCB), where the LED lamps, the LED lamp driving chip, the power positive pole connection terminal, the signal connection terminal and the power negative pole connection terminal are arranged on the PCB. The LED lamp driving chip is VIPER22A™, where the VIPER22A™ is a driving chip with an eight terminal pinout.

The disclosure further provides a lamp strip which includes a plurality of lamp beads. First signal connection terminals and second signal connection terminals of the plurality of lamp beads are sequentially connected in series. That is, the second signal connection terminal of the first lamp bead is connected to the first signal connection terminal of the second lamp bead, the second signal connection terminal of the second lamp bead is connected to the first signal connection terminal of the third lamp bead, and the rest may be sequentially implemented in the similar way. Power positive pole connection terminals of the plurality of lamp beads are connected with each other, and power negative pole connection terminals of the plurality of lamp beads are connected with each other. The lamp strip further includes a power supply and a controller; the power supply is connected to a power input end of the controller; a power positive pole output end of the controller is connected to the power positive pole connection terminals of the plurality of lamp beads, and a power negative pole output end of the controller is connected to the power negative pole connection terminals of the plurality of lamp beads; and a signal output end of the controller is connected to a first signal connection terminal of the first lamp bead of the plurality of lamp beads which are sequentially connected in series. The power supply, the controller and the plurality of lamp beads are connected through a circuit board, a wire or an enameled wire.

Example 1

Figure 3A:
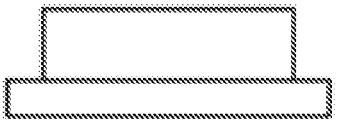
FIG. 3A is a schematic front view of a lamp bead packaging structure provided by Example 1 of the disclosure.
Figure 3B:
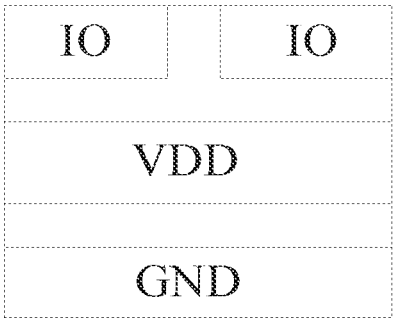
FIG. 3B is a schematic bottom view of the lamp bead packaging structure provided by Example 1.
Figure 4A:
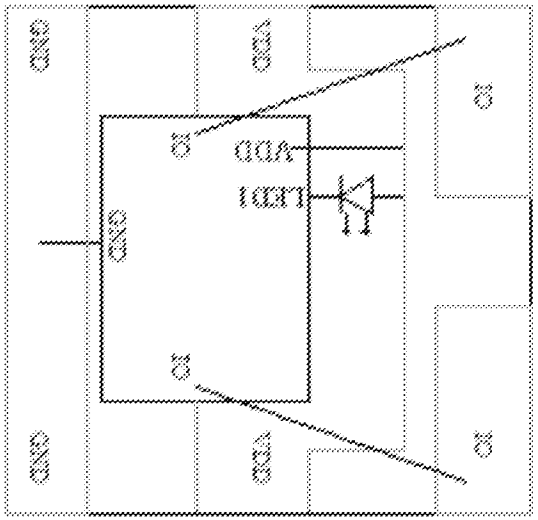
FIG. 4A is a schematic internal wiring diagram of the lamp bead packaging structure provided by Example 1 that includes an LED lamp.
Figure 4B:
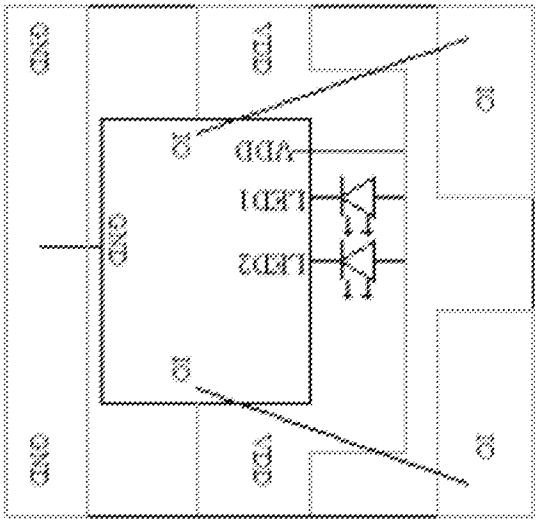
FIG. 4B is a schematic internal wiring diagram of the lamp bead packaging structure provided by Example 1 that includes two LED lamps.
Figure 4C:
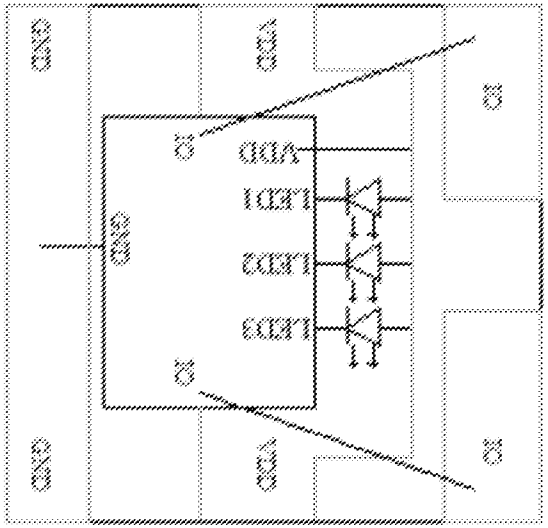
FIG. 4C is a schematic internal wiring diagram of the lamp bead packaging structure provided by Example 1 that includes three LED lamps.
Figure 4D:
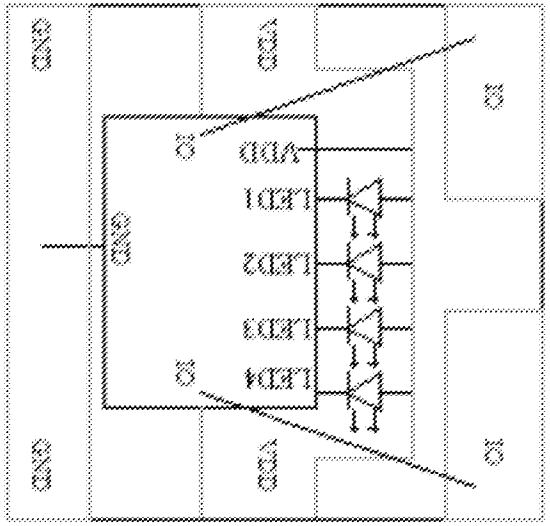
FIG. 4D is a schematic internal wiring diagram of the lamp bead packaging structure provided by Example 1 that includes four LED lamps.
Figure 5:
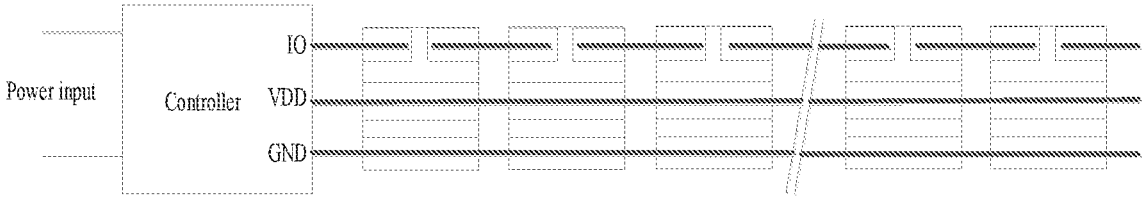
FIG. 5 is a schematic wiring diagram of a lamp strip composed of lamp beads provided by Example 1 of the disclosure.

As shown in FIGS. 3A-3B, a signal connection terminal, a power positive pole connection terminal and a power negative pole connection terminal of a lamp bead provided in Example 1 of the disclosure are sequentially arranged from top to bottom. An internal wiring mode of the lamp bead provided in Example 1 of the disclosure is shown in FIGS. 4A-4D. A wiring mode of a lamp strip composed of lamp beads provided in Example 1 of the disclosure is shown in FIG. 5.

Example 2

Figure 6:
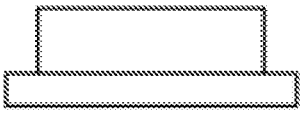
FIG. 6 is a front view of a lamp bead packaging structure provided by Example 2 of the disclosure.
Figure 7:
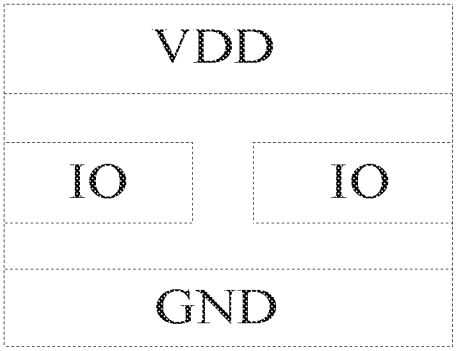
FIG. 7 is a bottom view of the lamp bead packaging structure provided by Example 2 of the disclosure.
Figure 8A:
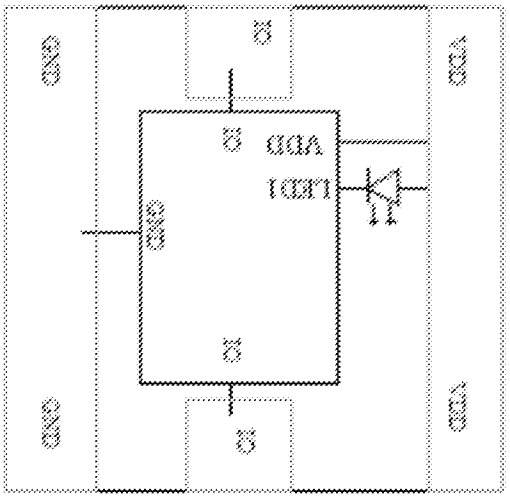
FIG. 8A is a schematic internal wiring diagram of the lamp bead packaging structure provided by Example 2 that includes an LED lamp.
Figure 8B:
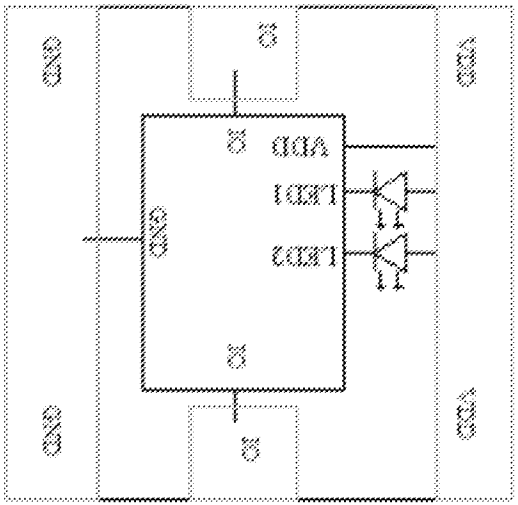
FIG. 8B is a schematic internal wiring diagram of the lamp bead packaging structure provided by Example 2 that includes two LED lamps.
Figure 8C:
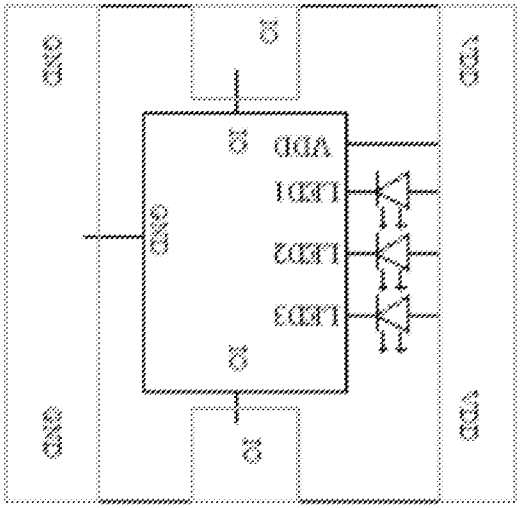
FIG. 8C is a schematic internal wiring diagram of the lamp bead packaging structure provided by Example 2 that includes three LED lamps.
Figure 8D:
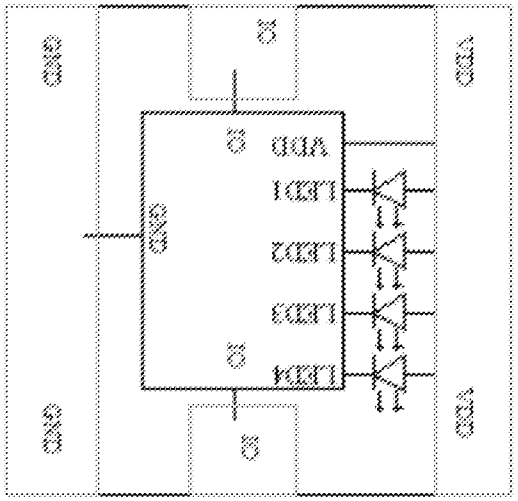
FIG. 8D is a schematic internal wiring diagram of the lamp bead packaging structure provided by Example 2 that includes four LED lamps.
Figure 9:
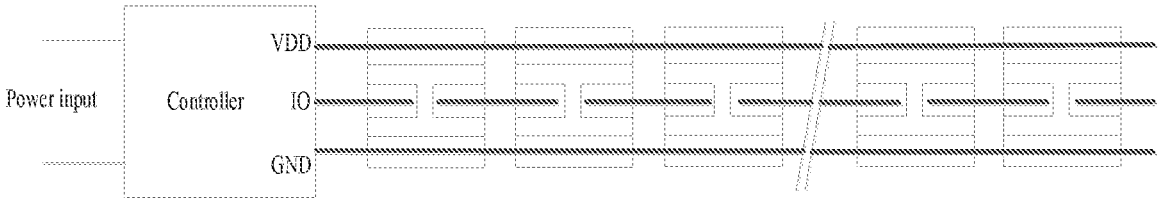
FIG. 9 is a schematic wiring diagram of a lamp strip composed of lamp beads provided by Example 2 of the disclosure.

As shown in FIGS. 6 and 7, a power positive pole connection terminal, a signal connection terminal and a power negative pole connection terminal of a lamp bead provided in Example 2 of the disclosure are sequentially arranged from top to bottom. An internal wiring mode of the lamp bead provided in Example 2 of the disclosure is shown in FIGS. 8A-8D. A wiring mode of a lamp strip composed of lamp beads provided in Example 2 of the disclosure is shown in FIG. 9.

As shown in FIGS. 3A-8D, positive poles, negative poles and IO ports of an LED lamp according to the disclosure are uniformly adjusted to ensure that the three lines can be parallel during wiring. This can greatly reduce welding points and the wiring length. The IO ports are in such a wiring mode that the IO ports of each LED lamp are directly cut off after welding. The lamp strip according to the disclosure includes a controller, lamp beads and wires. An IO (signal output end), a VDD (power positive pole output end) and a GND (power negative pole output end) of the controller are connected with an IO (signal connection terminal), a VDD (power positive pole connection terminal) and a GND (power negative pole connection terminal) of the lamp bead respectively.

The VDDs of all the beads are connected together, the GNDs of all the beads are connected together, the IO of the first lamp bead of the LED lamp is connected to the IO of the second lamp bead, the IO of the second lamp bead is connected to the IO of the third lamp bead, and the test is implemented in the similar way; and a plurality of lamp strips may also be connected end to end.

Figure 10A:
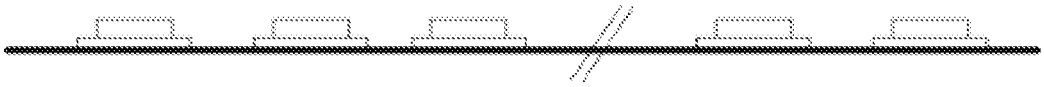
FIG. 10A is a wiring diagram of the lamp beads wired on the circuit board.
Figure 10B:
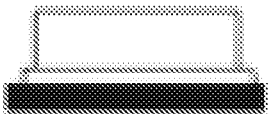
FIG. 10B is a structural diagram of the lamp beads wired on the circuit board.
Figure 11A:
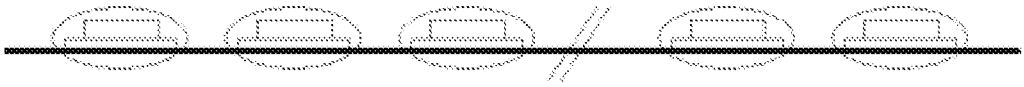
FIG. 11A is a wiring diagram of the lamp beads wired by ordinary wires or enameled wires.
Figure 11B:
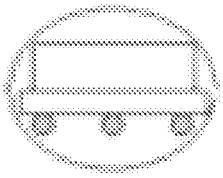
FIG. 11B is a structural diagram of the lamp beads wired by ordinary wires or enameled wires.
Figure 12A:
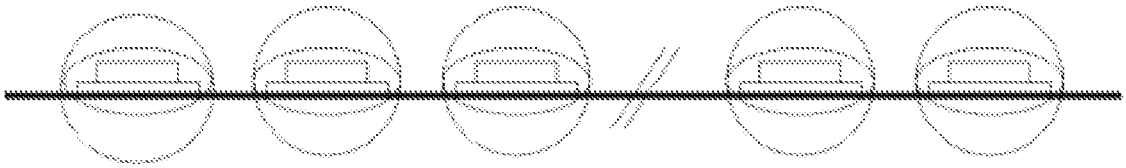
FIG. 12A is a wiring diagram showing that the lamp beads with the packaging housing are wired by ordinary wires or enameled wires.
Figure 12B:
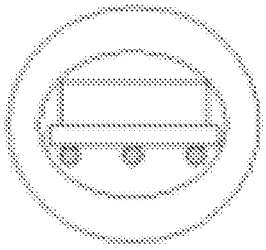
FIG. 12B is a structural diagram of the lamp beads provided with the packaging housing and wired by ordinary wires or enameled wires.

In the disclosure, a conductor connected to each port may be copper foil of a printed circuit board, or a wire with rubber, or an insulated enameled wire, and is very simple and convenient to manufacture and has high connection reliability. Because of simplify and convenience in manufacturing, the efficiency is greatly improved and the manufacturing cost is greatly reduced. FIGS. 10A-10B show schematic wiring diagrams of lamp beads connected on a circuit board; FIG. 11A-11B are schematic wiring diagrams of lamp beads connected by ordinary wires or enameled wires; and FIGS. 12A-12B are schematic wiring diagrams of lamp beads connected by ordinary wires or enameled wires after a protective housing is added to the lamp beads.

Each example of the description is described in a progressive manner, each example focuses on the difference from other examples, and the same and similar parts between the examples may refer to each other.

Specific examples are used herein for illustration of the principles and implementations of the disclosure. The description of the foregoing examples is only used to help understand the method of the disclosure and the core ideas thereof. In addition, those of ordinary skill in the art may make changes in terms of specific implementations and scope of application in accordance with the teachings of the disclosure. In conclusion, the content of the present specification shall not be construed as a limitation to the disclosure.

What is claimed is:

1. A lamp bead comprising:

a packaging housing, one or more LED lamps and an LED lamp driving chip;

wherein the LED lamps and the LED lamp driving chip are arranged in the packaging housing;

a power positive pole connection terminal, a signal connection terminal and a power negative pole connection terminal which are arranged longitudinally are exposed on an outer side of the bottom of the packaging housing; the signal connection terminal comprises a first signal connection terminal and a second signal connection terminal which are transversely arranged; the power positive pole connection terminal, the signal connection terminal and the power negative pole connection terminal pass through the bottom of the packaging housing;

a first signal end and a second signal end of the LED lamp driving chip are connected to the first signal connection terminal and the second signal connection terminal, respectively;

a power positive pole input end and a power negative pole input end of the LED lamp driving chip are connected to the power positive pole connection terminal and the power negative pole connection terminal, respectively;

anodes of the one or more LED lamps are connected to the power positive pole connection terminal; and cathodes of the one or more LED lamps are connected to one or more LED input ends of the LED lamp driving chip in a one-to-one correspondence manner, respectively;

the LED lamp driving chip comprises a driving chip with an eight terminal pinout.

2. The lamp bead according to claim 1, wherein the power positive pole connection terminal, the signal connection terminal and the power negative pole connection terminal are sequentially arranged from top to bottom; or the power negative pole connection terminal, the signal connection terminal and the power positive pole connection terminal are sequentially arranged from top to bottom; or the signal connection terminal, the power positive pole connection terminal and the power negative pole connection terminal are sequentially arranged from top to bottom; or the signal connection terminal, the power negative pole connection terminal and the power positive pole connection terminal are sequentially arranged from top to bottom.

3. A lamp strip, comprising a plurality of the lamp beads according to claim 2, wherein first signal connection terminals and second signal connection terminals of the plurality of lamp beads are sequentially connected in series, power positive pole connection terminals of the plurality of lamp beads are connected with each other, and power negative pole connection terminals of the plurality of lamp beads are connected with each other.

4. The lamp strip according to claim 3, further comprising a power supply and a controller;

wherein the power supply is connected to a power input end of the controller;

a power positive pole output end of the controller is connected to the power positive pole connection terminals of the plurality of lamp beads, and a power negative pole output end of the controller is connected to the power negative pole connection terminals of the plurality of lamp beads; and a signal output end of the controller is connected to a first signal connection terminal of the first lamp bead of the plurality of lamp beads which are sequentially connected in series.

5. The lamp strip according to claim 4, wherein the power supply, the controller and the plurality of lamp beads are connected through a circuit board, a wire or an enameled wire.

6. The lamp bead according to claim 1, wherein the power positive pole connection terminal, the signal connection terminal and the power negative pole connection terminal are in forms of welded pieces, pins and/or terminal blocks.

7. A lamp strip, comprising a plurality of the lamp beads according to claim 6, wherein first signal connection terminals and second signal connection terminals of the plurality of lamp beads are sequentially connected in series, power positive pole connection terminals of the plurality of lamp beads are connected with each other, and power negative pole connection terminals of the plurality of lamp beads are connected with each other.

8. The lamp strip according to claim 7, further comprising a power supply and a controller;

wherein the power supply is connected to a power input end of the controller;

a power positive pole output end of the controller is connected to the power positive pole connection terminals of the plurality of lamp beads, and a power negative pole output end of the controller is connected to the power negative pole connection terminals of the plurality of lamp beads; and a signal output end of the controller is connected to a first signal connection terminal of the first lamp bead of the plurality of lamp beads which are sequentially connected in series.

9. The lamp strip according to claim 8, wherein the power supply, the controller and the plurality of lamp beads are connected through a circuit board, a wire or an enameled wire.

10. The lamp bead according to claim 1, further comprising a printed circuit board (PCB), wherein the LED lamps, the LED lamp driving chip, the power positive pole connection terminal, the signal connection terminal and the power negative pole connection terminal are arranged on the PCB.

11. A lamp strip, comprising a plurality of the lamp beads according to claim 10, wherein first signal connection terminals and second signal connection terminals of the plurality of lamp beads are sequentially connected in series, power positive pole connection terminals of the plurality of lamp beads are connected with each other, and power negative pole connection terminals of the plurality of lamp beads are connected with each other.

12. The lamp strip according to claim 11, further comprising a power supply and a controller;

wherein the power supply is connected to a power input end of the controller;

a power positive pole output end of the controller is connected to the power positive pole connection terminals of the plurality of lamp beads, and a power negative pole output end of the controller is connected to the power negative pole connection terminals of the plurality of lamp beads; and a signal output end of the controller is connected to a first signal connection terminal of the first lamp bead of the plurality of lamp beads which are sequentially connected in series.

13. The lamp strip according to claim 12, wherein the power supply, the controller and the plurality of lamp beads are connected through a circuit board, a wire or an enameled wire.

14. A lamp strip comprising a plurality of the lamp beads according to claim 1, wherein first signal connection terminals and second signal connection terminals of the plurality of lamp beads are sequentially connected in series, power positive pole connection terminals of the plurality of lamp beads are connected with each other, and power negative pole connection terminals of the plurality of lamp beads are connected with each other.

15. The lamp strip according to claim 14, further comprising a power supply and a controller;

wherein the power supply is connected to a power input end of the controller;

a power positive pole output end of the controller is connected to the power positive pole connection terminals of the plurality of lamp beads, and a power negative pole output end of the controller is connected to the power negative pole connection terminals of the plurality of lamp beads; and a signal output end of the controller is connected to a first signal connection terminal of the first lamp bead of the plurality of lamp beads which are sequentially connected in series.

16. The lamp strip according to claim 15, wherein the power supply, the controller and the plurality of lamp beads are connected through a circuit board, a wire or an enameled wire.

17. A lamp strip, comprising a plurality of the lamp beads according to claim 1, wherein first signal connection terminals and second signal connection terminals of the plurality of lamp beads are sequentially connected in series, power positive pole connection terminals of the plurality of lamp beads are connected with each other, and power negative pole connection terminals of the plurality of lamp beads are connected with each other.

18. The lamp strip according to claim 17, further comprising a power supply and a controller;

wherein the power supply is connected to a power input end of the controller;

a power positive pole output end of the controller is connected to the power positive pole connection terminals of the plurality of lamp beads, and a power negative pole output end of the controller is connected to the power negative pole connection terminals of the plurality of lamp beads; and a signal output end of the controller is connected to a first signal connection terminal of the first lamp bead of the plurality of lamp beads which are sequentially connected in series.

19. The lamp strip according to claim 18, wherein the power supply, the controller and the plurality of lamp beads are connected through a circuit board, a wire or an enameled wire.

* * * * *